United States Patent [19]

Goodman

[11] 4,304,401

[45] Dec. 8, 1981

[54] QUADRICEPS EXERCISING DEVICE

[76] Inventor: Theodore Goodman, 25 S. Federal Hwy., Lake Worth, Fla. 33460

[21] Appl. No.: 115,438

[22] Filed: Jan. 25, 1980

[51] Int. Cl.[3] ..... A63B 21/04

[52] U.S. Cl. ..... 272/136; 272/142

[58] Field of Search ..... 272/139, 138, 142, 144, 272/135, 134, 900; 125/25 R, 25 B

[56] References Cited

U.S. PATENT DOCUMENTS

| | | | |
|---|---|---|---|
| 3,558,131 | 1/1971 | Dragon | 272/142 X |
| 4,098,502 | 7/1978 | Faust | 272/144 |
| 4,183,520 | 1/1980 | Chase | 272/134 X |

FOREIGN PATENT DOCUMENTS

| | | | |
|---|---|---|---|
| 2633148 | 1/1978 | Fed. Rep. of Germany | 272/134 |

*Primary Examiner*—Richard C. Pinkham
*Assistant Examiner*—William R. Browne
*Attorney, Agent, or Firm*—Malin & Haley

[57] ABSTRACT

A device for exercising the quadriceps muscles of a human body comprising a horizontally supported planar surface supported at chair height vertically by a pair of U-shaped bars forming four vertical support members. A horizontal bar is connected between the two rear legs of the device and have attached thereto an elastic band at one end. The user, in order to exercise the quadriceps muscle will sit in a chair with the device positioned in front of the chair and the leg to be exercised disposed over the horizontal platform at the knee joint. The elastic band is connected around the ankle or foot area and the leg is moved back and forth to the extended horizontal position against the tension of the elastic band.

1 Claim, 4 Drawing Figures

QUADRICEPS EXERCISING DEVICE

BACKGROUND OF THE INVENTION

This invention relates generally to an exercising device for a human being, and specifically to a device that is used for exercising the quadriceps muscles of the leg.

The knee is the largest joint in the human body. It is the hinge in the middle of the leg and is constantly exposed to injury. Stability of the knee joint depends primarily on the strength and tone of the quadriceps muscles which hold the joint extended. Ligaments of the knee joint are only of secondary help when compared with the muscles, although the integrity of the joint at the side depends on the ligaments. When the knee joint is affected by accident, operation, or disease, wasting of the local muscles occurs. This wasting can be very rapid, especially in the aged, and can only be corrected by hours of hard physical exercise by the patient. Massage and drugs do almost nothing for building up the vital muscle bulk, which can only be done through exercise by the patient.

The present invention allows the patient, while seated, to exercise the quadriceps muscles which may be necessitated by the broken leg, paralysis from a stroke, arthritis, or other similar knee-related problems. The device is also useful for athletes who need to condition these specific muscles.

BRIEF DESCRIPTION OF THE INVENTION

An exercising device for exercising the quadriceps muscles of the leg in a human being. The device includes a rigid, horizontally supported planar surface, the length of which approximates the diametral distance of a human leg, supported by four legs vertically disposed formed from two laterally mounted U-shaped tubes. The end of each leg includes a non-skid cap to prevent movement of the device and the legs on each side are spread slightly apart for greater stability.

The platform is supported above a floor surface slightly above conventional chair height. An additional horizontal bar is connected between the back leg and receives one end of an elastic band which is mounted thereupon. The free end of the elastic band is connected to the ankle or foot of the user and is tensioned such that when the leg is extended when supported upon the rigid, horizontal platform just behind the knee joint, the leg and quadriceps muscles must work against the tension of the band.

To operate the device, the patient is seated and the exercising device placed in front of the seated patient. The selected leg to be exercised is then placed over the top of the supporting platform and positioned relative to the patient so that the platform supports the leg just behind the knee joint. The elastic strap is then connected around the foot and then tightened to the desired tension within the capabilities of the patient. The patient then swings the leg from a vertical position to extend the leg against the tension of the elastic band, thus the leg lower portion below the knee cap is manipulated in a pendulum-like manner to and fro for the exercise. The device may actually be used by a patient that is confined to a wheel chair to eliminate the need for transferring the patient from the wheel chair to a stationary chair.

It is an object of this invention to provide a device specifically for exercising the quadriceps muscles.

It is another object of this invention to provide a lightweight, non-complex economical exercising device for rehabilitating the quadriceps muscles.

In accordance with these and other objects which will be apparent hereinafter, the instant invention will now be described with particular reference to the accompanying drawings.

PREFERRED EMBODIMENT OF THE INVENTION

Figure 1:
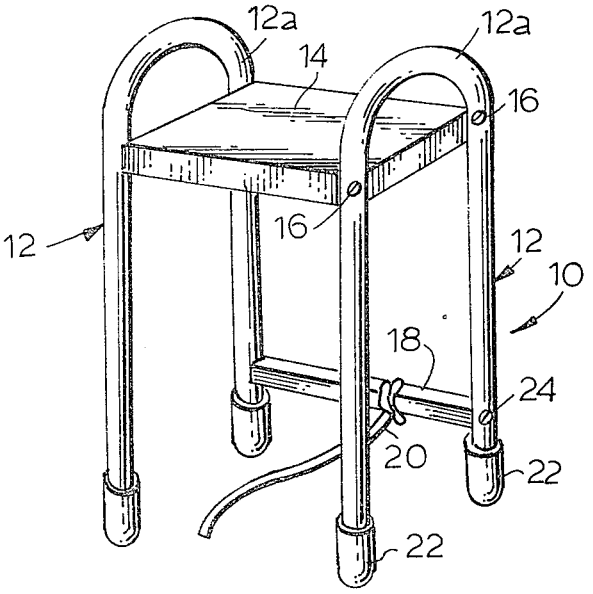
FIG. 1 shows a perspective view of the present invention.
Figure 2:
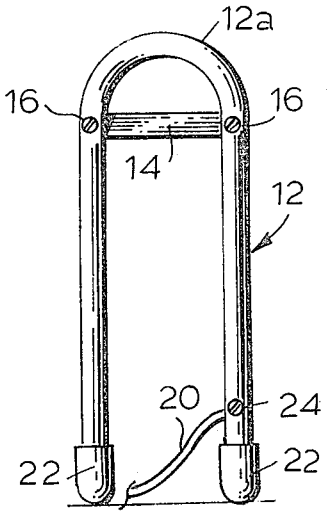
FIG. 2 shows a side elevational view of the present invention.

Referring now to the drawings and specifically FIG. 1, the present invention is shown generally at 10 comprised of two U-shaped bars 12 affixed to a rigid, horizontal supported platform 14 connected to the bars by screws 16. The lower free ends of the bars include caps 22 which enhance the frictional contact between the device 10 and the supporting surface such as a floor. The supporting rods 12 are somewhat divergent for additional support if necessary and include curved upper portion **12*a*** which may be used for grasping and allow ease in movement of the leg over the device. The bars themselves may be made of any suitable sturdy material including aluminum, plastic or the like, while the platform in this embodiment is made of wood.

Figure 3:
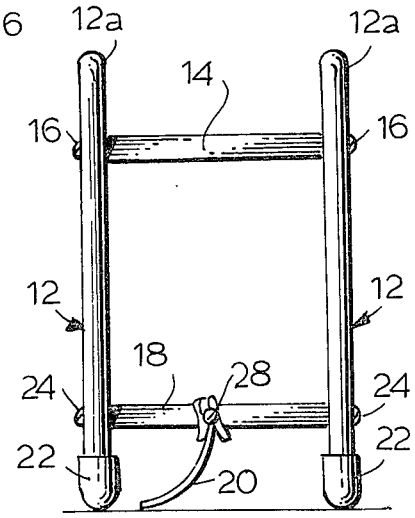
FIG. 3 shows a rear elevational view of the present invention.

An additional horizontal bar 18 is connected between the rear leg portions by screws 24 near the bottom of the legs. Affixed to the bar 18 is an elastic band 20. As shown in FIG. 3, the elastic band 20 may include a fastener 28 to secure the band to the bar 18.

Figure 4:
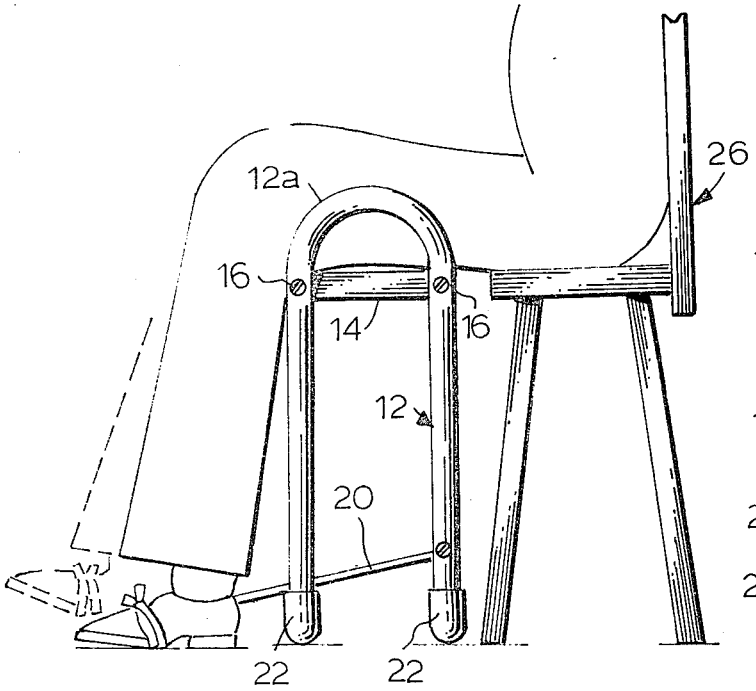
FIG. 4 shows a side elevational view of the present invention in operation.

To operate the device, the patient, as shown in FIG. 4, is seated in a conventional chair 26 with his leg disposed over platform 14 just slightly rear of the knee joint. The elastic band 20 is secured at its free end about the foot of the patient. As shown in the dotted portion, the patient then raises his leg against the tension in the elastic band 20, which produces and specifically causes the quadriceps muscles in the particular leg being exercised to be thoroughly conditioned.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A portable, therapeutic device for exercising the quadricep muscles of a human body which allows a patient seated in a chair or wheelchair to completely exercise the quadricep muscle comprising:

a rigid, horizontally supported planar surface having a pair of lateral sides, a front side, and a rear side;

a plurality of rigid, vertical support members connected on the lateral sides of said horizontal surface, said horizontal surface sized laterally to receive a patient's leg and sized from front to rear to allow a patient seated in a chair or wheelchair to support the patient's leg from the knee area toward the patient, said horizontally supported planar surface being attached to said rigid vertical support members at substantially conventional chair seat height above the floor;

a rigid bar disposed between two of said vertical leg portions near the lower portion of said leg;

a plurality of floor engaging friction cups connected at the end of each vertical support member to prevent slippage of the vertical support members; and an elastic band connected at one end to said horizontal bar, said horizontal planar surface being disposed above the floor at conventional chair height whereby a seated patient in a chair or wheelchair affixes the free end of the elastic band to his lower foot or ankle area and disposes the upper leg portion over the horizontal surface, said band being sized to provide tensioning when said patient moves his leg or foot between therapeutic positions of muscular extension and flection.

* * * * *